United States Patent [19]

Peiker

[11] Patent Number: 4,811,405

[45] Date of Patent: Mar. 7, 1989

[54] MICROPHONE MOUNTING SUPPORT

[76] Inventor: Andreas Peiker, Terracinaweg 5, 6380 Bad Homburg v.d.Höhe, Fed. Rep. of Germany

[21] Appl. No.: 55,857

[22] Filed: Jun. 1, 1987

[30] Foreign Application Priority Data

Aug. 18, 1986 [CH] Switzerland ..... 3299/86

[51] Int. Cl.[4] ..... H04R 1/02

[52] U.S. Cl. ..... 381/169; 381/188; 381/205

[58] Field of Search ..... 381/168, 169, 87, 88, 381/89, 90, 91, 188, 205; 248/229, 185, 299, 296, 231.8, 154, 27.3, 205.2, 221.3, 221.4, 222.1, 222.2, 231.4–231.9, 316.7; 24/455, 464, 467, 470, 476, 485, 546

[56] References Cited

U.S. PATENT DOCUMENTS

| | | | |
|---|---|---|---|
| 1,680,723 | 8/1928 | Bloom et al. | 248/299 |
| 1,774,775 | 9/1930 | Weitz, Jr. | 248/299 |
| 2,755,126 | 7/1956 | Ludlow | 248/299 |
| 3,370,818 | 2/1968 | Perr | 248/205.2 |
| 3,452,955 | 7/1969 | Hartwig | 381/205 |
| 3,521,332 | 7/1970 | Kramer | 248/229 |
| 3,907,239 | 9/1975 | Ehrlich | 248/229 |
| 3,928,734 | 12/1975 | Noury, Jr. | 381/205 |
| 4,040,547 | 8/1977 | Dickey | 248/229 |
| 4,126,827 | 11/1978 | Negrini | 381/205 |
| 4,146,191 | 3/1979 | Cavanaugh | 381/169 |
| 4,146,757 | 3/1979 | Murad | 381/169 |
| 4,151,467 | 4/1979 | Kongelka et al. | 381/169 |
| 4,215,250 | 7/1980 | Resener | 381/169 |
| 4,367,572 | 1/1983 | Zielenski | 248/154 |
| 4,466,596 | 8/1984 | Cohen | 248/231.4 |
| 4,577,070 | 3/1986 | Shulman | 381/205 |

*Primary Examiner*—Gerald L. Brigance
*Assistant Examiner*—Richard Hjerpe
*Attorney, Agent, or Firm*—Brady, O'Boyle & Gates

[57] ABSTRACT

The mounting support (2) consists of a U-shaped clamping strap. A holder (4) carrying the microphone (5) is mounted displaceably to the curved portion (3) of the clamping strap (2). The axial direction (7) of the microphone (5) wherein the latter has its maximum sensitivity can be adjusted with respect to the sound source by displacing the microphone holder (4) along the curved strap portion (3).

The extremely simple, economically producible microphone mounting support permits accurate adjustment of the direction of maximum sensitivity to the sound source, independently of the position of the object to which the mounting support is fastened; this is important for a transmission free of feedback, especially during hand-free two-way communication.

17 Claims, 4 Drawing Sheets

MICROPHONE MOUNTING SUPPORT

The invention relates to a microphone mounting support.

A simple microphone mounting support is the clip (spring clip or clasp) with which the microphone can be clamped or clasped to an object.

In the conventional, simple mounting supports of this type, the microphone is fixedly attached to the clip so that the position of the microphone is determined by the position of the object to which the clip is fastened. Heretofore it has been practically impossible to obtain, by means of simply mounting supports, a good directional effect, i.e. an alignment of the microphone in such a way that its direction of maximum sensitivity is oriented toward the sound source. Such a directional effect is required, above all, in hands-free duplex communication for a transmission devoid of feedback.

The invention is based on the object of providing a maximally simple and economically producible microphone mounting support which makes it possible to orient the microphone direction of maximum sensitivity onto the sound source independently of the position of the object serving for the attachment of the mounting support.

This object has been attained as set forth in claim 1. Preferred embodiments are recited in claims 2 through 18.

Figure 1:
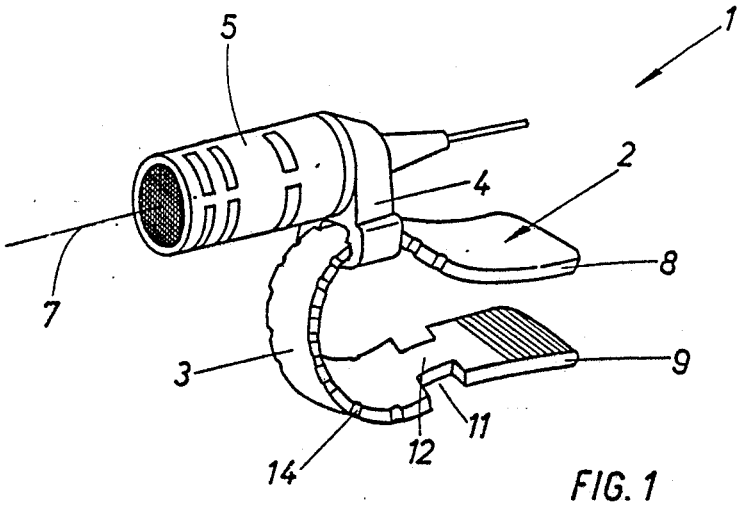
Figure 2:
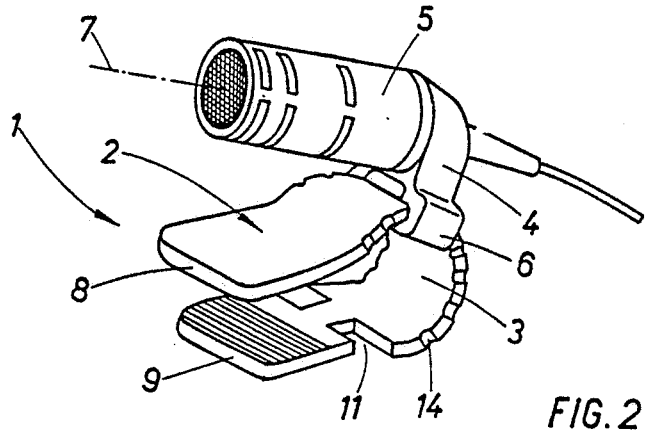
Figure 3:
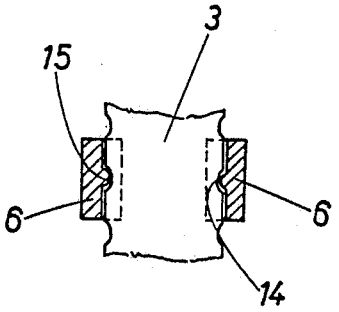
Figure 4:
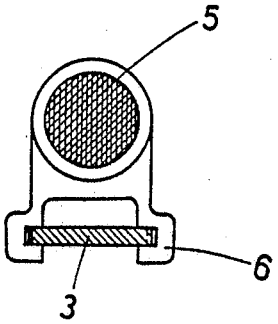
Figure 6:
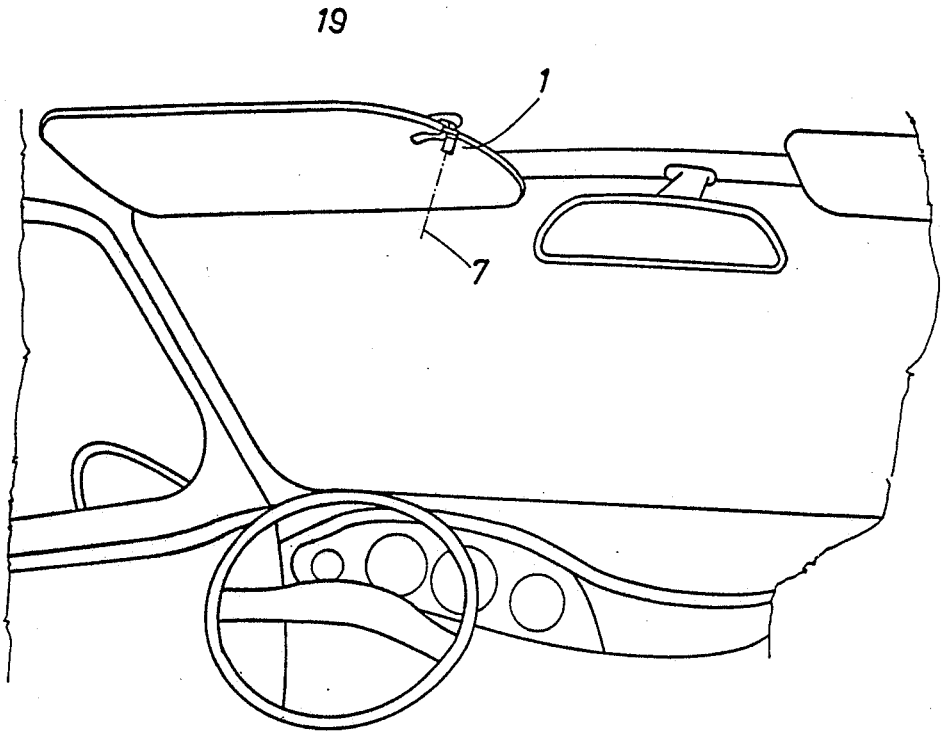
Figure 5:
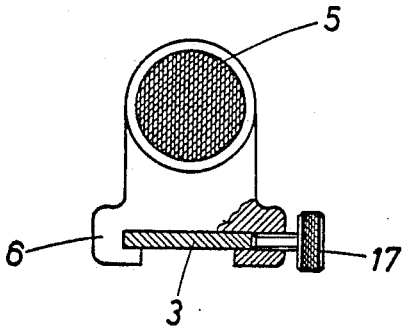
Figure 7:
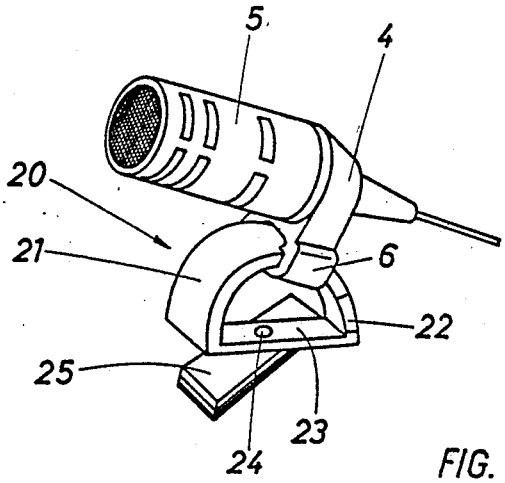
Figure 8:
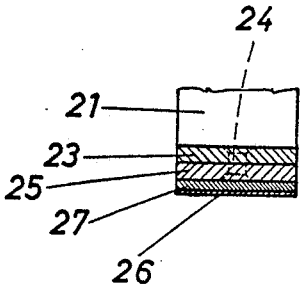
Figure 9:
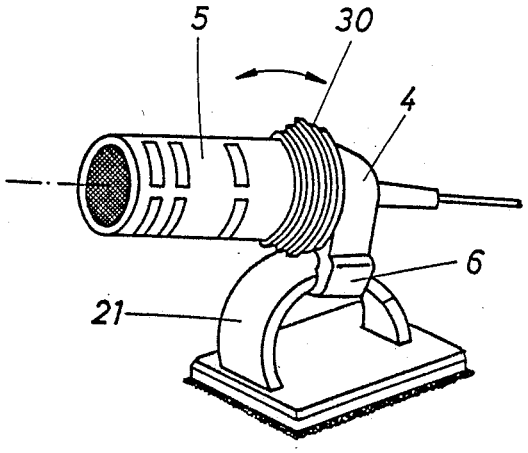

Embodiments of the invention will be described below with reference to the drawings wherein:

FIG. 1 shows a perspective view of a clip-on microphone,

FIG. 2 shows a perspective view of the clip-on microphone with a microphone attached to the clip in the opposite direction, FIG. 3 shows a sectional view, parallel to the axis of the microphone, through the location where the microphone holder is mounted to the curved portion of the clip, FIG. 4 shows a sectional view, perpendicular to the microphone axis, through the location where the microphone holder is mounted to the curved portion of the clip, FIG. 5 shows a sectional view corresponding to FIG. 4 through a modification of the clip-on microphone, FIG. 6 shows a view of the clip-on microphone attached to the sun visor of an automobile, FIG. 7 shows a perspective view of another microphone mounting support, FIG. 8 is a section through the swivel joint of the mounting support of FIG. 7, and FIG. 9 is a perspective view of a modification of the microphone mounting support of FIG. 7.

The clip-on microphone 1 illustrated in FIGS. 1–4 has a clip 2 consisting of a U-shaped clamping strap, a holder 4 being displaceably supported on the curved portion 3 thereof. A directional microphone 5 is retained by a clamping seat in this holder. The strap 2 is made of a strip of elastic material, and the holder 4, likewise consisting of an elastic material, comprises two jaws 6 extending around the narrow sides of the strip; due to the elasticity of the holder, these jaws are pressed against the narrow sides of the strip.

The direction wherein the microphone 5 has its maximum sensitivity extends in the axis 7 of the cylindrical microphone housing. The axis 7 extends in parallel to the jaw surfaces 6 so that it extends in each case tangentially to the curvature at the location of the strap portion 3 encompassed by the jaws 6. The strap portion 3 has an at least approximately circular-arc shape, and its diameter of curvature is about twice as large as the spacing of the two strap legs 8, 9, so that the circumference of the strap section 3 is adequately large to permit exact adjustment of the microphone axis 7 into the direction pointing toward the sound source, namely to shift the jaws 6 exactly to he point of the strap portion 3 at which the tangent exhibits the desired direction.

The width of the strap legs 8, 9 is larger than the width of the curved strap portion 3, and the strip has two recessed 11 at the transition between the curved strap portion 3 and one of the legs, 9 (at the bottom in the drawing). (Correspondingly, two recesses could also be provided at the transition to the other leg 8.) On the narrow zone 12 of the strip, formed by the recessed 11, the jaws 6 can be detached from the clip 2 and can be reattached, so that the microphone 5 can be quickly removed and remounted in the opposite direction, as illustrated in FIGS. 1 and 2.

In order to secure the holder 4 to the strap part 3, locking or clamping means are provided. In the embodiment shown in FIGS. 1–4, pairs of locking indentations 14 are arranged on the narrow sides of the strap portion 3, and corresponding pairs of locking nubs 15 are provided at the jaws 6 which interlock with the pairs of locking indentations 14 and can be released only when overcoming the elasticity of the holder 4. In the version illustrated in FIG. 5, a clamping screw 17 is located on one of the jaws 6.

The clip-on microphone 1 can be utilized, in particular, for voice transmission in the mobile field of usage, for example, for a hands-off two-way auto telephone (hands-free telephone), a mobile radio unit, etc. One usage is illustrated in FIG. 6. The clip-on microphone 1 is attached to the sun visor 19 of an automotive vehicle. The clip 2 can be attached, depending on where the microphone cord is to be run downwards, and depending on the position of the sun visor 19, to the left-hand or right-hand lateral rim or, alternatively, to one of the two longitudinal rims of the sun visor 19; the microphone 5, as mentioned above in connection with the narrow zone 12, can be attached, if necessary, to the strap 2 rotated by 180°. In order to orient the microphone axis 7 to the driver's (or front passenger's) mouth, this axis can be pivoted in a plane in parallel to the sun visor 19 as well as in a vertical plane. In the parallel plane, the axis 7 is pivoted by rotating the clip 2 at the sun visor 19, during which step the friction resistance of the strap legs 8, 9, clamped to the sun visor 19, is to be overcome. The axis 7 is pivoted in the plane perpendicular thereto by shifting the holder 4 along the curved strap portion, the axis 7 orienting itself in parallel to the respective tangential plane at the location of the strap portion 3 encompassed by the jaws 6. During this procedure, the pairs of locking nubs 15 respectively engage into the pairs of locking indentations 14 arranged in succession at brief spacings, so that the microphone holder 4 can be secured in any desired position.

In the version 20 of the microphone mounting support illustrated in FIGS. 7 and 8, the jaws 6 of the microphone holder 4 are urged, by the elasticity of the latter, against a circular-arc-shaped strap 21 along which the jaws can be displaced while overcoming the friction. In order to attach the jaws 6 to the strap 21, the latter carries at one end a recess 22. The strap 21 is formed integrally with a plate 23 constituting one member of a self-locking swivel joint and being connected by means of a rivet connection 24 rotatably with a corresponding plate 25 embodying the other rotary member.

The swivel joint is self-locking because the two plates 23, 25 are pressed against each other by the rivet connection 24, i.e. can be rotated with respect to each other only while overcoming the friction of the mutually contacting plate surfaces. A plate 27 equipped with a "Velcro" strip 26 is glued to the plate 25.

The mounting support 20 can be attached, by means of the "VELCRO" strip 26, for example, to the headliner of an automobile, and the microphone 5, as explained in connection with FIG. 6, can be utilized for a free-hands two-way automobile telephone. The simple swivel joint 23-25 and the displaceabililty of the holder 4 along the strap 21 make it possible to align the microphone axis exactly with the mouth of the driver (or of the front passenger). Since the swivel joint 23-25 as well as the displacement of the jaws 6 along the strap 21 is self-locking, the microphone 5 remains in the set position. Instead of using the swivel joint 23-25, a swivel joint which permits a corresponding rotation of the microphone 5 could also be provided at the microphone holder 4, i.e. the holder 4 could consist of two rotatable members, one of which carries the microphone 5 and the other of which carries the jaws 6.

In the version of the microphone mounting support illustrated in FIG. 9, the strap 21 is formed of one piece with a plate, the latter exhibiting on its underside, attached thereto, a "Velcro" strip (flat zipper), with which the plate can be mounted, for example, to the headliner of an automobile. The version of FIG. 9, since it has no joint, is simpler than the embodiment of FIGS. 7 and 8, and the problem is circumvented of providing a reliable locking or catching of the joint in the desired position, encountered due to wear after a longer-term usage. Yet, the microphone direction can also be adjusted along the lines of a rotation of the swivel joint 23-25, by detaching the "Velcro" strip from the mounting site and, after adjusting the desired position, reattaching this strip. (In this respect, the same conditions apply as in the clip-on microphone of FIG. 1 wherein the clip can be rotated while overcoming the friction resistance of the strap legs 8, 9.)

The rear end of the microphone housing 5 is attached to a hollow base 30 consisting of colored acrylic glass. The front part of the base 30, visible in the drawing, has a staggered shape, i.e. the shape of several rings, the diameters of which increase toward the center, and projects radially beyond the microphone housing 5. The rear part of the base 30, not visible in the drawing, has a cylindrical configuration and is inserted in the holder 4 with a clamping seat. A lamp (not illustrated) is arranged in the cavity of the base 30 and illuminates the base from the inside. The lamp can, for example, be turned on and off with the microphone in case of a two-way voice communication unit so that the user recognizes, from the fact that the base part projecting in a bead-like fashion over the microphone housing is illuminated, that readiness for voice communication exists. The lamp can also be turned on at night to locate the position of the microphone.

An important advantage of the invention is to be seen in that the displaceable positioning of the microphone holder at the curved part of the mounting support permits exact setting of the microphone direction without the need for a joint. This solution is simpler structurally than a joint and avoids the problem of proper locking or catching in the desired position, encountered with a joint due to wear and tear, especially after rather long usage.

I claim:

1. A mounting support for mounting a microphone in selected positions comprising; a holder (4) for receiving the microphone (5); a curved strap portion (3; 21) having broad top and bottom surfaces, relatively thin opposite side edges, and opposite ends; means (8, 9; 23, 24, 25) connected to said opposite ends of said curved strap portion for mounting the same to a surface; said holder having a pair of jaws (6) extending below the microphone and around said opposite side edges of said curved strap portion in sliding engagement therewith; a recess (11; 22) in at least one of said relatively thin opposite side edges adjacent one of the opposite ends of said curved strap portion (3; 21) producing thereat a zone (12) in the broad top and bottom surfaces of the curved strap portion narrower than the distance between said pair of jaws (6) at which the jaws (6) and holder (4) can be connected to and detached from said curved strap portion; whereby said holder is displaceable along said curved strap portion to orient the microphone in selected position.

2. Mounting support according to claim 1, characterized in that the curved strap portion (3; 21) has an at least approximately circular-arc-shaped curvature.

3. Mounting support according to claim 2, in which said means includes a swivel joint (23, 24, 25) including two members, the opposite ends of said curved strap portion (21) connected to one member (23) of the swivel joint (23-25), the other member (25) of the swivel joint being equipped with fastening means (26).

4. Mounting support according to claim 3, characterized in that the two swivel joint members consist of two plates (23, 25) rotatably connected with each other, by a rivet connection (24), and the one plate member (23) constituting one swivel joint member is formed integrally with the curved strap portion (21).

5. Mounting support according to claim 3 or 4, characterized in that the fastening means are designed in the manner of a "Velcro" closure.

6. Mounting support according to claim 3, characterized in that the microphone (5) is firmly seated in the holder (4) with a clamping seat.

7. Mounting support according to claim 1, characterized in that said means connected to said opposite ends of the curved strap portion (3) comprises a clip (2).

8. Mounting support according to claim 7, characterized in that the clip consists of a U-shaped clamping strap (2).

9. Mounting support according to claim 8, characterized in that the U-shaped clamping strap (2) is formed from a strip of an elastic material.

10. Mounting support according to claim 8, characterized in that said clip (2) comprising two strap legs (8, 9) respectively connected to said opposite ends of said curved strap portion (3), the diameter of curvature of the curved strap portion (3) is larger than the spacing of the two strap legs (8, 9) from each other.

11. Mounting support according to claim 8, characterized in that said clip (2) comprising two strap legs (8, 9) respectively connected to said opposite ends of said curved strap portion (3), and said curved strap portion (3) has a radius of curvature at least as large as the spacing of the two strap legs (8, 9).

12. Mounting support according to claim 8, characterized in that said clip (2) comprising two strap legs (8, 9) respectively connected to said opposite ends of said curved strap portion (3), and the width of the strap legs (8, 9) is larger than the width of the curved strap portion (3).

13. Mounting support according to claim 1, characterized by locking or clamping means (14, 15; 17) on at least said holder or said curved strap portion for securing the holder (4) and, respectively, the jaws (6) at selective locations along the curved strap portion (3).

14. Mounting support according to claim 13, characterized in that the curved strap portion (3) and the holder and, respectively, the jaws (6) include locking nubs (15) and cooperating locking indentations (14) for receiving the locking nubs (15), so that the holder (4) can be secured in locked positions along the curved strap portion (3).

15. Mounting support according to claim 1, including a microphone base (30), the rear end of the microphone (5) attached to one end of said base (3), said base (30) radially projecting beyond the microphone (5), said base consisting of a translucent or transparent material and adapted to be illuminatable from the inside by means of a lamp, the rear end of said base being connected to the holder (4).

16. A mounting support for mounting a microphone in selected positions comprising; a holder (4) for receiving the microphone (5); a self-locking swivel joint assembly (23, 24, 25) including a first plate member (23), a second plate member (25), and a pivot member (24) connecting said first plate member (23) for rotation relative to said second plate member (25); a substantially semi-circular strap portion (21) having opposite ends; said first plate member (23) formed integrally with said semi-circular strap portion (21) and extending between said opposite ends; means connected to the bottom surface of said second plate member (25) for mounting the same to a surface; said semi-circular strap portion (21) having opposite side edges; said holder (4) having a pair of resiliently yieldable jaws (6) formed integrally therewith and extending around and enclosing said opposite side edges of said semi-circular strap portion (21) therewith; said pair of resiliently yieldable jaws (6) urged by their resilience into sliding friction engagement with said opposite side edges; whereby the jaws (6) are slidable along said substantially semi-circular strap portion (21) while overcoming the resilient friction engagement to position the microphone in selected positions along the length of said substantially semi-circular strap portion.

17. A mounting support for mounting a microphone in selected positions comprising; a holder (4) for receiving the microphone (5); a curved strap portion (3; 21) having broad top and bottom surfaces, relatively narrow opposite side edges, and opposite ends; means (8, 9; 23, 24, 25) connected to said opposite ends of said curved strap portion for mounting the same to a surface; said holder (4) having a pair of elastically yieldable jaws (6) formed integrally therewith extending around and urged by the elasticity thereof into friction engagement with said relatively narrow opposite side edges; at least one of the elastically yieldable jaws (6) having at least one locking nub (15); at least the corresponding relatively narrow side edge of said relatively narrow opposite side edges cooperating with said at least one jaw (6) having a plurality of locking indentations (14) distributed along the whole length of said curved strap portion (3; 21) adapted to selectively receive said at least one locking nub (15); the said at least one locking nub (15) being urged by the elasticity of said at least one jaw (6) into the respective locking indentation (14), and released therefrom only by overcoming the elastically yieldable force of the jaw (6) by forcing said holder (4) to move along said curved strap portion; whereby said jaws (6) can be moved along the curved strap portion (3; 21) and the microphone (5) can be secured in a plurality of different selected locked positions along the curved strap position.

* * * * *